US009026002B2

(12) United States Patent
Sato et al.

(10) Patent No.: US 9,026,002 B2
(45) Date of Patent: May 5, 2015

(54) IMAGE FORMING APPARATUS HAVING DEVELOPING UNIT IN WHICH DEVELOPING DEVICE IS MOVABLY DISPOSED

(71) Applicants: Shougo Sato, Seto (JP); Hirotaka Mori, Nagoya (JP); Makoto Souda, Nagoya (JP)

(72) Inventors: Shougo Sato, Seto (JP); Hirotaka Mori, Nagoya (JP); Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 43 days.

(21) Appl. No.: 13/773,682

(22) Filed: Feb. 22, 2013

(65) Prior Publication Data

US 2013/0223878 A1 Aug. 29, 2013

(30) Foreign Application Priority Data

Feb. 29, 2012 (JP) ..... 2012-044038

(51) Int. Cl.
*G03G 15/04* (2006.01)
*G03G 21/18* (2006.01)

(52) U.S. Cl.
CPC ..... *G03G 21/1817* (2013.01); *G03G 21/1821* (2013.01)

(58) Field of Classification Search
CPC ..... G03G 15/0896; G03G 21/1676; G03G 21/1817; G03G 2221/163
USPC ..... 399/119
See application file for complete search history.

(56) References Cited

U.S. PATENT DOCUMENTS

| | | | |
|---|---|---|---|
| 7,319,834 | B2 | 1/2008 | Yamaguchi |
| 8,107,855 | B2 | 1/2012 | Nishimura et al. |
| 2006/0216061 | A1 | 9/2006 | Yamaguchi |
| 2007/0098438 | A1 | 5/2007 | Yamaguchi |
| 2008/0138115 | A1 | 6/2008 | Chadani et al. |
| 2009/0226209 | A1 | 9/2009 | Shiraki et al. |
| 2009/0317133 | A1 | 12/2009 | Nishimura et al. |

FOREIGN PATENT DOCUMENTS

| | | | |
|---|---|---|---|
| JP | 06-348123 | A | 12/1994 |
| JP | 2006-267602 | A | 10/2006 |
| JP | 2008-170944 | A | 7/2008 |
| JP | 2009-216802 | A | 9/2009 |
| JP | 2010-008511 | A | 1/2010 |

*Primary Examiner* — Erika J Villaluna
(74) *Attorney, Agent, or Firm* — Banner & Witcoff, Ltd.

(57) ABSTRACT

An image forming apparatus includes: a main body; a photosensitive drum rotatably supported in the main body; a developing unit detachably accommodated in the main body in a direction along an axis of the photosensitive drum in a state where the photosensitive drum is disposed in the main body. The developing unit includes: a developer carrying member configured to carry developer for supplying the developer to the photosensitive drum; a developing frame supporting the developer carrying member; and a supporting assembly configured to support the developing frame such that, in a state where the developing unit is accommodated in the main body, the developing frame is movable between a proximity position where the developer carrying member and the photosensitive drum being positioned adjacent to or in contact with each other and a separation position where the developer carrying member and the photosensitive drum being separated from each other.

11 Claims, 9 Drawing Sheets

IMAGE FORMING APPARATUS HAVING DEVELOPING UNIT IN WHICH DEVELOPING DEVICE IS MOVABLY DISPOSED

CROSS REFERENCE TO RELATED APPLICATION

This application claims priority from Japanese Patent Application No. 2012-044038 filed Feb. 29, 2012. The entire content of the priority application is incorporated herein by reference.

TECHNICAL FIELD

The present invention relates to an electrophotographic type image forming apparatus.

BACKGROUND

There is conventionally known an electrophotographic type image forming apparatus including a main frame and a process cartridge detachably mountable in the main frame.

For example, there is proposed a process cartridge integrally having a photosensitive drum and a developing unit including a developing roller, and the process cartridge is detachably attached to a main frame of an image forming apparatus in an axial direction of the photosensitive drum.

Service life of such process cartridge generally depends upon the service life of the developing unit which is comparatively shorter than that of the photosensitive drum.

In the above image forming apparatus, since the process cartridge integrally has the photosensitive drum and developing unit, both the photosensitive drum and developing unit need to be replaced simultaneously when the service life of the developing unit is reached. Thus, there is a limit in reduce running cost.

Thus, there is a demand to develop an image forming apparatus in which a developing unit can be detachably attached to a main frame independently of a photosensitive member.

In such an image forming apparatus, in order to prevent interference between a developing roller and the photosensitive member during attachment and detachment of the developing unit relative to the main frame, the developing unit needs to movable between a position at which the developing roller and photosensitive member contact each other (contact position) and a position at which the developing roller and photosensitive member are separated from each other (separation position).

As such image forming apparatus in which the developing unit is configured to be movable in this manner, there is proposed an electrophotographic copier whose main frame (copier body) is provided with a photosensitive belt and a guide rail configured to be movable with respect to the main frame. A developing unit is configured to be attached/detached relative to the main frame while being guided by the guide rail. Moving the guide rail in a state where the developing unit has been attached to the main frame permits the developing unit to move between the contact position and the separation position.

In this electrophotographic copier, the developing unit is attached to/detached from the main frame when the developing unit is at the separation position.

SUMMARY

However, in this electrophotographic copier, the developing unit is attached to and detached from the main frame while being guided by the guide rail which is movable relative to the main frame. Therefore, attachment/detachment of the developing unit with respect to the main frame may become unstable.

As a result, the developing roller and photosensitive belt may interfere with each other during attachment/detachment of the developing unit, thereby possibly causing damages to the developing roller and photosensitive belt.

Incidentally, it is conceivable that such interference between the developing roller and photosensitive belt can be prevented if a sufficient gap is ensured between the developing roller and photosensitive belt. However, providing such a gap inevitably leads to increase in size of the entire electrophotographic copier.

In view of the foregoing, it is an object of the present invention to provide an image forming apparatus capable of reducing running costs, preventing damages to a photosensitive drum and developer carrier, and realizing downsizing of the image forming apparatus.

In order to attain the above and other objects, the present invention provides an image forming apparatus including a main body, a photosensitive drum, and a developing unit. The photosensitive drum is rotatably supported in the main body, the photosensitive drum defining an axis. The developing unit is detachably attachable to the main body in an attachment direction along the axis of the photosensitive drum in a state where the photosensitive drum is disposed in the main body. The developing unit includes: a developer carrying member configured to carry developer thereon for supplying the developer to the photosensitive drum; a developing frame supporting the developer carrying member; and a supporting assembly configured to support the developing frame such that the developing frame is movable between a proximity position and a separation position in a state where the developing unit is accommodated in the main body. When the developing frame is at the proximity position, the developer carrying member and the photosensitive drum being positioned adjacent to or in contact with each other, and when the developing frame is at the separation position, the developer carrying member and the photosensitive drum being separated from each other.

According to another aspect, the present invention provides an image forming apparatus including: a main body; a photosensitive drum; a developing unit; and a guide member. The photosensitive drum is disposed in the main body, the photosensitive drum being configured to rotate about a rotational axis. The developing unit includes: a developer carrying member configured to supply developer to the photosensitive drum; a developing frame supporting the developer carrying member; and a supporting assembly supporting the developing frame. The guide member is configured to support the supporting assembly in the main body and guide movement of the supporting assembly relative to the main body in an attachment direction along the rotational axis of the photosensitive drum. The developing frame is configured to move between a proximity position and a separation position in a state where the developing unit is attached to the main body, a distance between the developer carrying member and the photosensitive drum when the developing frame is at the proximity position being smaller than a distance between the developer carrying member and the photosensitive drum when the developing frame is at the separation position.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
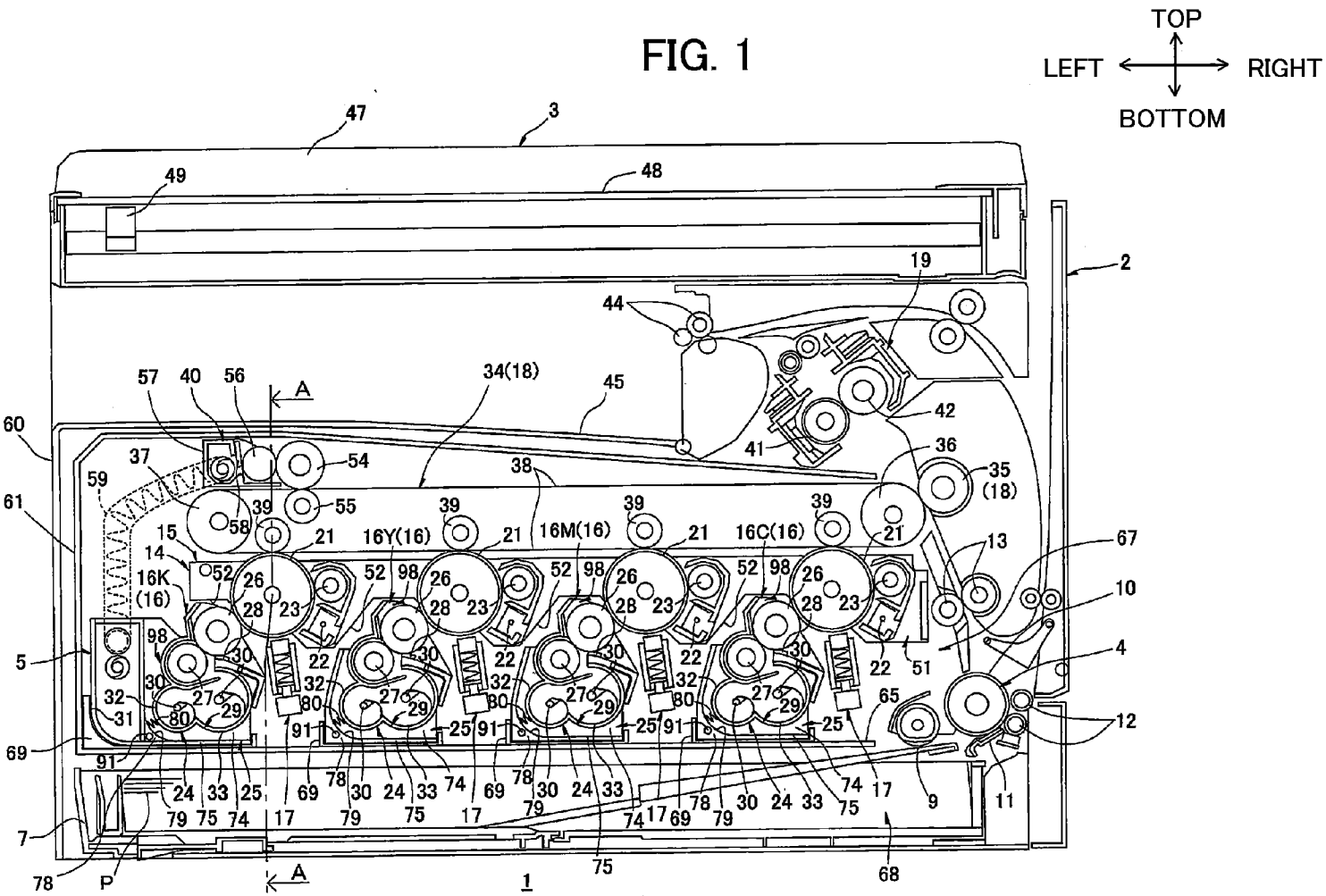
FIG. 1 is a cross-sectional view showing a general construction of a color printer as an example of an image forming apparatus according to a first embodiment of the present invention.

A printer 1 as an example of an image forming apparatus according to a first embodiment of the present invention will be described while referring to FIGS. 1 through 6C.

1. Overall Structure of the Printer

The printer 1 is a horizontal color printer employing an intermediate-transfer type.

The printer 1 is a multifunction device that integrally includes a casing 2 and a flat head scanner 3 disposed above the main casing 2. The flat head scanner 3 functions to read information on images from an original.

The printer 1 also includes a sheet supply unit 4 and an image forming unit 5 disposed within the main casing 2. The sheet supply unit 4 functions to supply sheets P to the image forming unit 5. The image forming unit 5 functions to form images on the sheets P supplied from the sheet supply unit 4.

(1) Main Casing

Figure 2:
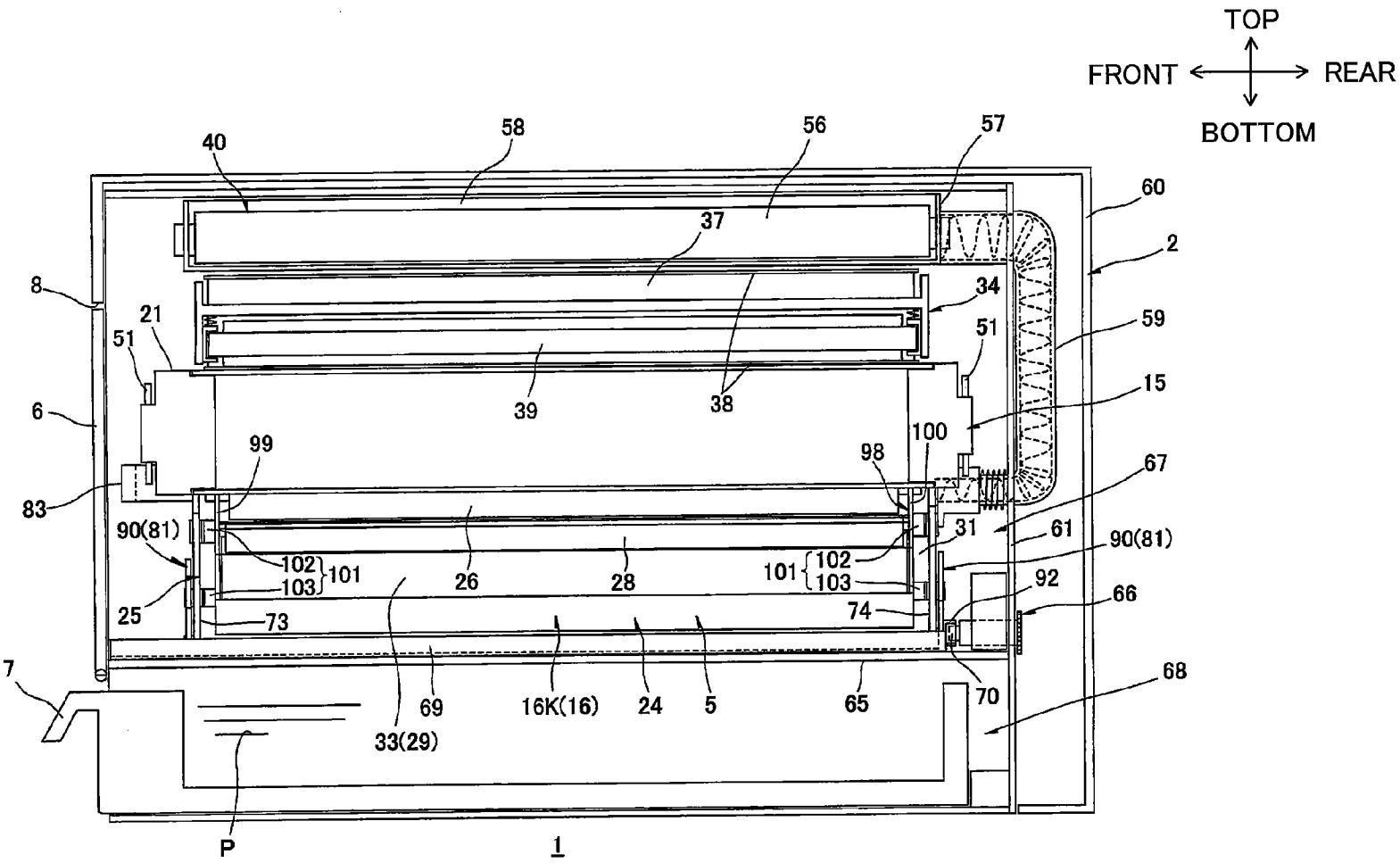
FIG. 2 is a cross-sectional view of the color printer of FIG. 1 taken along a line A-A shown in FIG. 1, wherein a developing unit is accommodated in a main casing.
Figure 3:
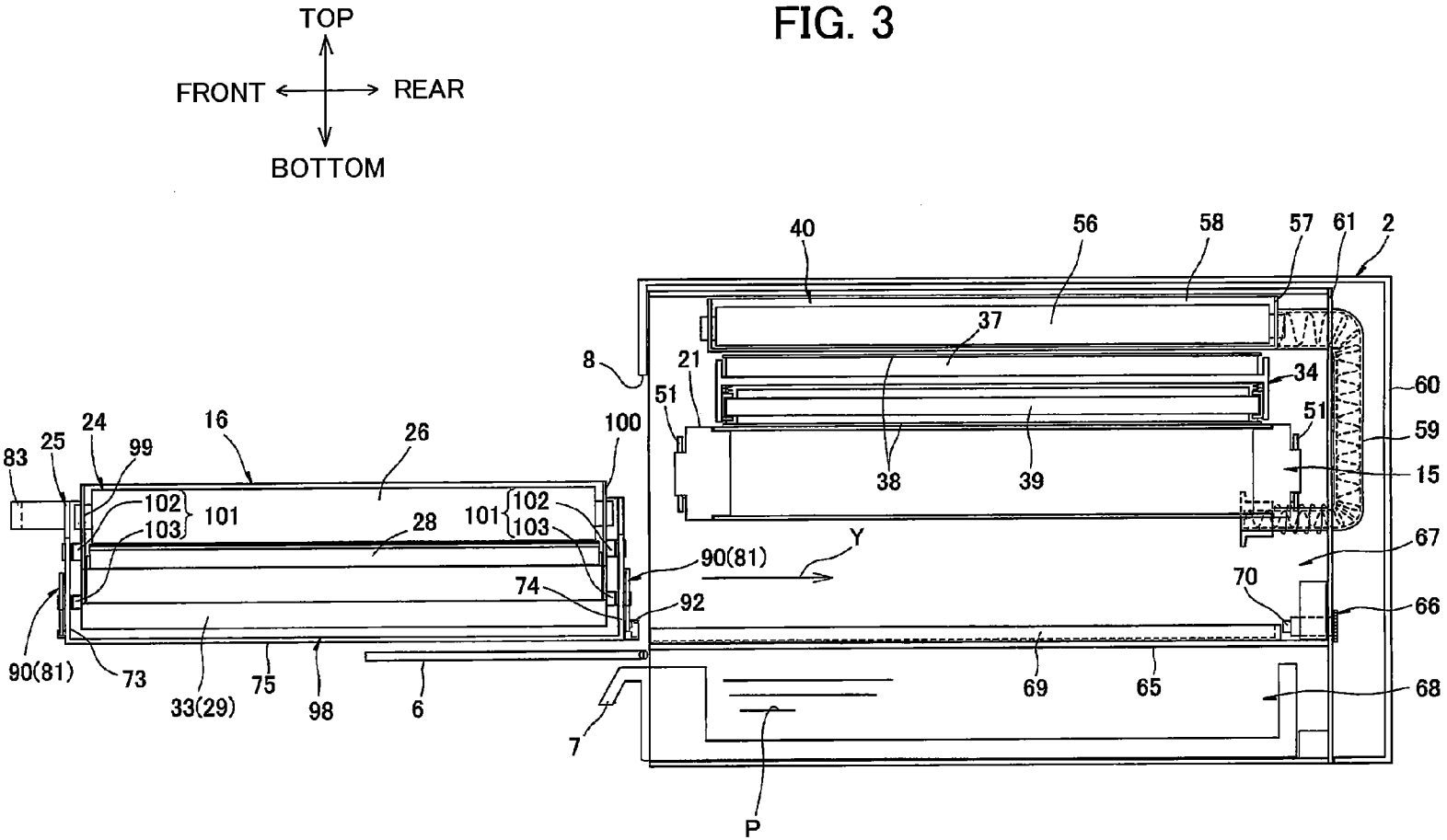
FIG. 3 is a cross-sectional view of the color printer of FIG. 1 taken along the line A-A shown in FIG. 1, wherein a developing unit is pulled out from the main casing.

As shown in FIGS. 1 and 2, the main casing 2 is generally box-shaped. The main casing 2 has one side in which a main body aperture 8 is formed (see FIG. 2). The main casing 2 also includes a front cover 6 that is pivotally movable about its lower end portion (see FIG. 2) so as to open and close the main body aperture 8. FIG. 2 shows a state where the front cover 6 closes the front cover 6, and FIG. 3 shows a state where the front cover 6 opens the main body aperture 8.

In the following description, the side at which the front cover 6 is provided is defined as a front side of the printer 1, while the side opposite to the front side will be defined as a rear side of the printer 1. Specifically, in FIG. 2, the left side corresponds to the front side, and the right side corresponds to the rear side of the printer 1.

Further, left and right sides of the printer 1 will be defined based on an orientation in which the printer 1 is viewed from its front side. That is, in FIG. 1, the left side is defined as a left side of the printer 1, and the right side is a right side of the printer 1. The near side of FIG. 1 corresponds to the front side, and the far side of FIG. 1 corresponds to the rear side of the printer 1.

(2) Sheet Supplying Unit

The sheet supply unit 4 includes a sheet supply tray 7 for accommodating the sheets P therein. The sheet supply tray 7 is detachably attached to a bottom portion of the main casing 2.

The sheets P accommodated in the sheet supply tray 7 are fed between a sheet supply roller 10 and a sheet supply pad 11 by rotation of a pickup roller 9, and then separated one by one by rotation of the sheet supply roller 10. Then, each sheet P is sequentially fed upward, while passing between the sheet supply roller 10 and each pinch roller 12, and toward between a pair of registration rollers 13. Subsequently, each sheet P is supplied, at a predetermined timing, to the image forming unit 5 (between an intermediate transfer belt 38 (to be described later) and a secondary transfer roller 35 (to be described later)) by rotation of the registration rollers 13.

(3) Image Forming Unit

The image forming unit 5 is disposed upward of the sheet supply unit 4 and includes a process unit 14, a transfer unit 18, and a fixing unit 19.

(3-1) Process Unit

The process unit 14 is disposed above the sheet supply tray 7 and includes a drum unit 15, a plurality of (four) developing units 16, and a plurality of (four) LED units 17.

(3-1-1) Drum Unit

The drum unit 15 is disposed at an upper end portion of the process unit 14. The drum unit 15 integrally holds a plurality of (four) photosensitive drums 21, a plurality of (four) scorotron chargers 22, and a plurality of (four) drum cleaning rollers 23.

The four photosensitive drums 21 corresponding to four colors (black, yellow, magenta, and cyan) are arranged in parallel spaced apart from each other in a left-right direction. That is, the photosensitive drum 21 defines an axis extending in a front-rear direction.

The scorotron chargers 22 are disposed to correspond to the photosensitive drums 21 respectively. Each scorotron charger 22 is disposed to oppose the corresponding photosensitive drum 21 at a position diagonally below rightward thereof with a space provided therebetween.

The drum cleaning rollers 23 are also provided to correspond to the respective photosensitive drums 21. Each drum cleaning roller 23 is disposed above the corresponding scorotron charger 22 such that the drum cleaning roller 23 is in contact with the corresponding photosensitive drum 21 from rightward thereof.

(3-1-2) Developing Unit

The plurality of (four) developing units 16 are provided to correspond to the plurality of (four) photosensitive drums 21. As will be descried in detail later, each developing unit 16 is configured to slide in the front-rear direction between a mounted position (FIG. 2) and a detached position (FIG. 3). In the mounted position, the developing unit 16 is mounted in the main casing 2, while in the detached position the developing unit 16 is withdrawn from the main casing 2.

In the mounted position, each developing unit 16 is positioned diagonally leftward and downward of the corresponding photosensitive drum 21. The developing units 16 are juxtaposed in the left-right direction when accommodated in the main casing 2. More specifically, a black developing unit 16K, a yellow developing unit 16Y, a magenta developing unit 16M, and a cyan developing unit 16C are arrayed in line from the left side to right side.

Figure 4:
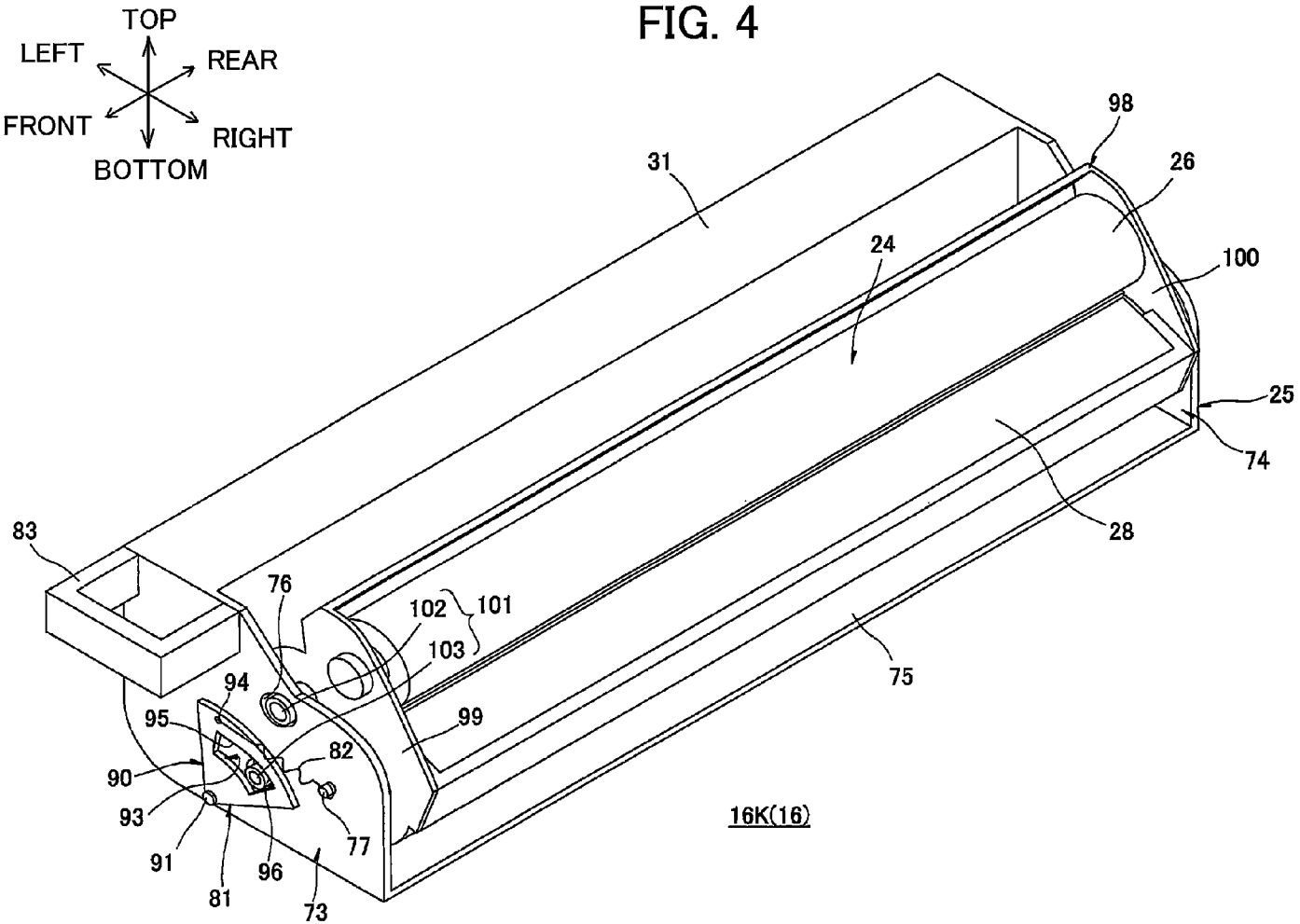
FIG. 4 is a perspective view of the developing unit shown in FIG. 1 as viewed from upward and frontward thereof.

Each developing unit 16 includes a developing device 24 and a unit frame 25, as illustrated in FIG. 4.

The developing device 24 is accommodated in the unit frame 25. Each developing device 24 includes a developing roller 26, a supply roller 27, a thickness regulating blade 28 and a toner chamber 29.

As illustrated in FIG. 1, the developing roller 26 is rotatably supported to an upper end portion of the developing device 24 so as to be exposed therefrom upward (diagonally upward and rightward). The developing roller 26 is configured to be brought into contact with the corresponding photosensitive drum 21 from below and leftward thereof when the developing unit 16 is mounted in the main casing 2.

The supply roller 27 is provided for supplying toner to the developing roller 26. The thickness regulating blade 28 is provided for regulating a thickness of the toner supplied to the developing roller 26. The toner chamber 29 is disposed below the supply roller 27 for storing toner of a corresponding color (black, yellow, magenta, or cyan).

The toner chamber 29 is configured of a first chamber 32 and a second chamber 33 disposed adjacent to each other in the left-right direction. The first chamber 32 corresponds to a left-side portion of the toner chamber 29, while the second chamber 33 corresponds to a right-side portion of the toner chamber 29. The first chamber 32 and the second chamber 33 are both formed in a substantially cylindrical shape extending in the left-right direction, but the second chamber 33 has an inner diameter larger than that of the first chamber 32. An agitator 30 for agitating the toner is disposed in each inner space of the first chamber 32 and second chamber 33 at a position substantially center thereof. The inner spaces of the first chamber 32 and the second chamber 33 are in fluid communication with each other.

Further, the unit frame 25 of the black developing unit 16K integrally retains, at the left side thereof, a substantially box-shaped waste toner chamber 31.

(3-1-3) LED Unit

The LED units 17 are supported to the main casing 2 such that each LED unit 17 is disposed in correspondence with the corresponding developing unit 16 so as to oppose the same from below. The LED unit 17 exposes a surface of the corresponding photosensitive drum 21 based on predetermined image data.

(3-2) Transfer Unit

The transfer unit 18 is disposed above the process unit 14 and includes a belt unit 34 and the secondary transfer roller 35.

The belt unit 34 is disposed in the left-right direction so as to face each of the four photosensitive drums 21 from above.

The belt unit 34 includes a drive roller 36, a follow roller 37, the intermediate transfer belt 38, a plurality of (four) primary transfer rollers 39, and a belt cleaner 40.

The drive roller 36 and follow roller 37 are disposed in opposition to and in separation from each other in the left-right direction.

The intermediate transfer belt 38 is an endless belt disposed above the photosensitive drums 21 such that a lower portion of the intermediate transfer belt 38 opposes and contacts each of the photosensitive drums 21. The intermediate transfer belt 38 is stretched taut and mounted on the drive roller 36 and follow roller 37. As the drive roller 36 rotates, the follow roller 37 is caused to rotate via the intermediate transfer belt 38. The intermediate transfer belt 38 is thus circularly movable such that the lower portion thereof contacting the photosensitive drums 21 moves from left to right.

The plurality of (four) primary transfer rollers 39 are provided in an internal space of the intermediate transfer belt 38 such that each primary transfer roller 39 opposes the corresponding photosensitive drum 21 via the lower portion of the intermediate transfer belt 38.

The belt cleaner 40 is disposed above a left end portion of the intermediate transfer belt 38. The belt cleaner 40 includes a belt cleaning roller 54, an opposing roller 55, a relay roller 56, and a waste toner storage portion 57.

The belt cleaning roller 54 is provided upward of the intermediate transfer belt 38 so as to oppose the opposing roller 55 via the intermediate transfer belt 38 in a top-down direction.

The relay roller 56 is disposed leftward of the belt cleaning roller 54 so as to be in contact with the same.

The waste toner storage portion 57 has a substantially rectangular box shape in a side view, and is disposed leftward of the relay roller 56. The waste toner storage portion 57 has a right side wall in which an opening is formed to penetrate therethrough in the left-right direction. A scraping blade 58 is provided at a peripheral end portion of the opening.

The toner remaining on the surface of the intermediate transfer belt 38 (waste toner) is cleaned by the belt cleaning roller 54, once retained by the relay roller 56, and scraped by the scraping blade 58 to be fed to the waste toner storing portion 57 through the opening. The waste toner stored in the waste toner storing portion 57 is conveyed to the waste toner chamber 31 (of the black developing unit 16K) to be stored therein through a waste toner conveying pipe 59 (see FIGS. 1 and 2) connecting between a rear end of the waste toner storing portion 57 and a rear end of the waste toner chamber 31.

The secondary transfer roller 35 is provided on the right side of the belt unit 34 and opposes the drive roller 36 via the intermediate transfer belt 38.

(3-3) Fixing Unit

The fixing unit 19 is disposed upward and leftward of the secondary transfer roller 35. The fixing unit 19 includes a heat roller 41 and a pressure roller 42. The pressure roller 42 is positioned diagonally upward and rightward of the heat roller 41 so as to be in pressure contact with the heat roller 41.

(3-4) Image Forming Operation (3-4-1) Developing Operation

Toner accommodated in the toner chamber 29 is supplied to the supply roller 27 by the agitators 30, and then supplied onto the surface of the developing roller 26.

As the developing roller 26 rotates, the toner on the developing roller 26 is regulated by the thickness regulating blade 28 and carried on the surface of the developing roller 26 as a thin layer having a uniform thickness.

Meanwhile, in accordance with rotation of the photosensitive drum 21, the surface of each photosensitive drum 21 is positively charged by the corresponding scorotron charger 22 and then exposed to light by the corresponding LED unit 17. Accordingly, an electrostatic latent image based on an image to be formed on the sheet P is formed on the surface of each photosensitive drum 21.

As the photosensitive drum 21 further rotates, the toner borne on the surface of the developing roller 26 is supplied to the electrostatic latent image formed on the surface of the corresponding photosensitive drum 21. In this way, the electrostatic latent image is developed into a visible toner image, and the toner image is carried on the surface of each photosensitive drum 21.

(3-4-2) Transfer/Fixing Operations

The toner image carried on the surface of each photosensitive drum 21 is sequentially superimposed onto the lower portion of the intermediate transfer belt 38 running from left to right (primary transfer). A color image is thus formed on the surface of the intermediate transfer belt 38.

The color image on the intermediate transfer belt 38 is then transferred onto the sheet P supplied from the sheet supply unit 4, while the intermediate transfer belt 38 passes between the secondary transfer roller 35 and the drive roller 36 (secondary transfer).

The color image transferred onto the sheet P is then thermally fixed thereto with heat and pressure in the fixing unit 19, while the sheet P passes between the heat roller 41 and the pressure roller 42.

(4) Sheet Discharge

The sheet P on which the color image has been fixed in the fixing unit 19 is then discharged onto a discharge tray 45 formed on an upper surface of the main casing 2.

(5) Flat Head Scanner

The flat head scanner 3 is disposed above the discharge tray 45. In the flat head scanner 3, an original is placed between a pressing cover 47 and a glass surface 48. Image data on the original is then scanned by a slidable CCD sensor 49.

Based on the scanned image data, images can be formed on the sheet P in the image forming unit 5, as described above.

2. Detailed Structure of the Main Casing

As shown in FIG. 2, the main casing 2 includes an outer casing 60 constituting an outer shape of the color printer 1 and an inner casing 61 provided inside the outer casing 60.

The outer casing 60 is formed in a substantially rectangular box shape in a side view, and includes the front cover 6 at a front end thereof.

The inner casing 61 is formed in a substantially rectangular box shape in a side view. The inner casing 61 has dimensions large enough to accommodate therein the sheet supply unit 4 (see FIG. 1) and the image forming unit 5 in the up-down direction and in the left-right direction. The inner casing 61 is accommodated within the outer casing 60 such that the inner casing 61 is displaced frontward so as to have its rear wall spaced away from a rear wall of the outer casing 60.

The inner casing 61 includes a partition wall 65 and four main body couplings 66.

The partition wall 65 has a substantially flat-plate shape. The partition wall 65 is provided between the sheet supply tray 7 and the developing units 16 in the up-down direction such that the partition wall 65 vertically partitions an internal space of the inner casing 61 into a unit accommodating space 67 and a sheet supply tray accommodating space 68. The unit accommodating space 67 is positioned above the sheet supply tray accommodating space 68.

Four guide portions 69 are fixed to an upper surface of the partition wall 65. As illustrated in FIGS. 1 and 2, four guide portions 69 are provided to correspond to the four developing units 16, respectively.

As illustrated in FIGS. 1 and 2, each guide portion 69 is formed in a substantially tray-like shape (see FIG. 2). Specifically, each guide portion 69 has a substantially U-like shape in a front view (see FIG. 1) and extends in the front-rear direction. That is, the guide portion 69 is opened at its front and its top. The guide portion 69 has an inner surface having a shape in conformance with an outer shape of a lower end portion of the corresponding unit frame 25. The guide portion 69 has inner dimensions (lengths in the left-right direction and in the front-rear direction) substantially equal to outer dimensions (lengths in the left-right direction and in the front-rear direction) of the unit frame 25.

Further, the length of the guide portion 69 in the front-rear direction is shorter than a length of the partition wall 65 in the front-rear direction. As illustrated in FIG. 2, the guide portion 69 is fixed to the upper surface of the partition wall 65 such that the guide portion 69 has a front end portion generally coincident with a front end portion of the partition wall 65 in the front-rear direction. As a result, the guide portion 69 has a rear end portion spaced apart from a rear wall of the inner casing 61 in the front-rear direction.

The main body couplings 66 are provided in correspondence with four developing units 16 to be accommodated within the inner casing 61. The main body couplings 66 are disposed between the rear end portion of corresponding guide portion 69 and the rear wall of the inner casing 61. Each main body coupling 66 is rotatably supported by the rear wall of the inner casing 61. Each main body coupling 66 has a front end portion on which a coupling portion 70 is provided. The coupling portion 70 has a substantially columnar shape extending in the front-rear direction.

3. Detailed Structure of the Drum Unit (1) Drum Frame

The drum unit 15 includes, as illustrated in FIG. 2, a pair of drum frames 51 disposed in opposition to and in separation each other in the front-rear direction.

As illustrated in FIG. 1, each drum frame 51 has a substantially flat plate-like shape elongated in the left-right direction. Each drum frame 51 has a lower edge portion in which four unit grooves 52 are formed.

Each unit groove 52 is formed by cutting a portion of the drum frame 51 therefrom, the portion overlapping with the developing device 24 of the corresponding developing unit 16 (upper end portion of the corresponding developing device 24) when the developing unit 16 is projected in the front-rear direction.

More specifically, the unit groove 52 corresponding to the black developing unit 16K is formed by cutting a left end portion of the drum frame 51. The unit groove 52 extends rightward from a vertically center of the left end portion of the drum frame 51 and then slopes downward toward the right.

Each of the other three unit grooves 52 corresponding to the developing units 16Y, 16M, and 16C (yellow developing unit 16Y, magenta developing unit 16M, and cyan developing unit 16C) has a substantially U-shape that is open downward. Each unit groove 52 is formed by cutting a portion of the lower edge portion of each drum frame 51 upward therefrom.

For each developing unit 16, the photosensitive drum 21, scorotron charger 22, and drum cleaning roller 23 described above are supported between the pair of drum frames 51.

As illustrated in FIG. 2, the photosensitive drum 21 has a substantially cylindrical shape extending in the front-rear direction. Both end portions of the photosensitive drum 21 are rotatably supported by the respective drum frames 51. That is, the photosensitive drum 21 is rotatably provided relative to the main casing 2.

4. Detailed Structure of the Developing Unit

In the present embodiment, as illustrated in FIG. 1, the black developing unit 16K, yellow developing unit 16Y, magenta developing unit 16M, and cyan developing unit 16C are juxtaposed in the left-right direction. The four developing units 16 have the same configuration as one another except in that: only the black developing unit 16K is provided with the waste toner chamber 31; and the black developing unit 16K has a gripping portion 83 (to be described later) provided at a position different from those of the gripping portions 83 of the other developing units 16. Thus, hereinafter, detailed descriptions will be given on the black developing unit 16K, and descriptions for the developing units 16Y, 16M, and 16C will be omitted.

(1) Unit Frame

Figure 5A:
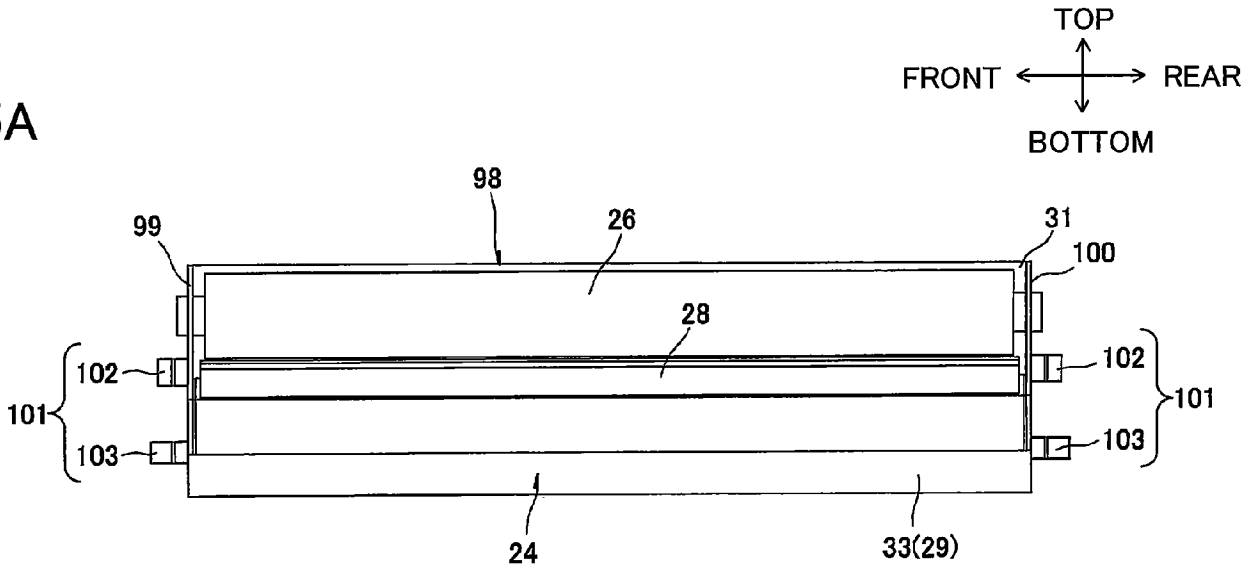
FIG. 5A is a right side view of the developing unit shown in FIG. 1, the developing unit including a developing device and a unit frame.
Figure 5B:
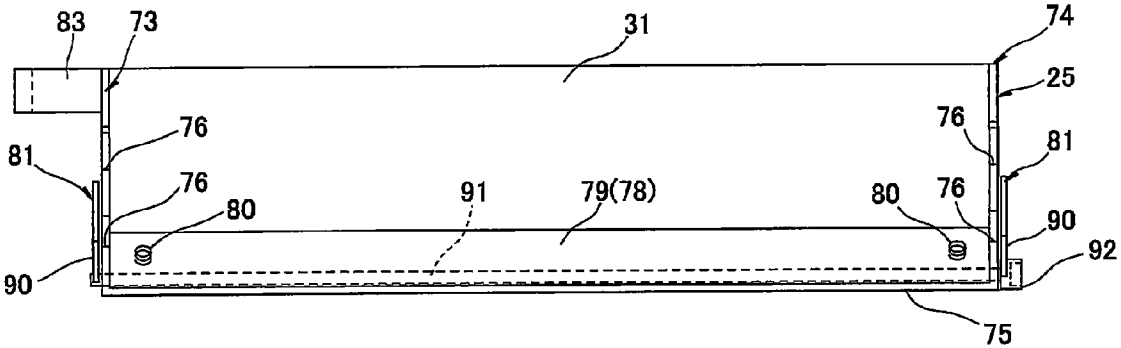
FIG. 5B is a right side view of the developing unit shown in FIG. 1, wherein the developing device is removed from the unit frame.

As illustrated in FIG. 5B, the unit frame 25 has a substantially U-like shaped side view that is open upward. The unit frame 25 includes a unit front wall 73, a unit rear wall 74, and a unit bottom wall 75. The unit front wall 73 and unit rear wall 74 are disposed to oppose each other in the front-rear direction with a space provided therebetween. The unit bottom wall 75 spans between lower end portions of the unit front wall 73 and unit rear wall 74.

In the present embodiment, the unit front wall 73 and unit rear wall 74 have the same configuration as each other. Thus, hereinafter, the unit front wall 73 will be described in detail, and descriptions of the unit rear wall 74 will be omitted.

Figure 6B:
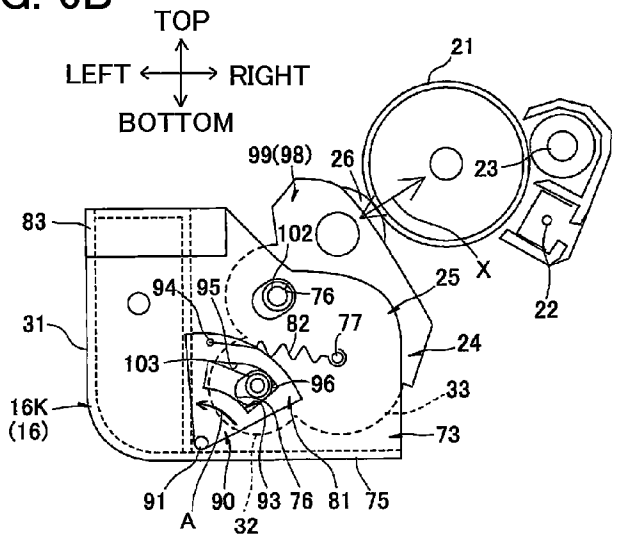
FIG. 6B is a front side view of the developing unit shown in FIG. 1, wherein the developing frame of the developing device is at a proximity position.
Figure 6A:
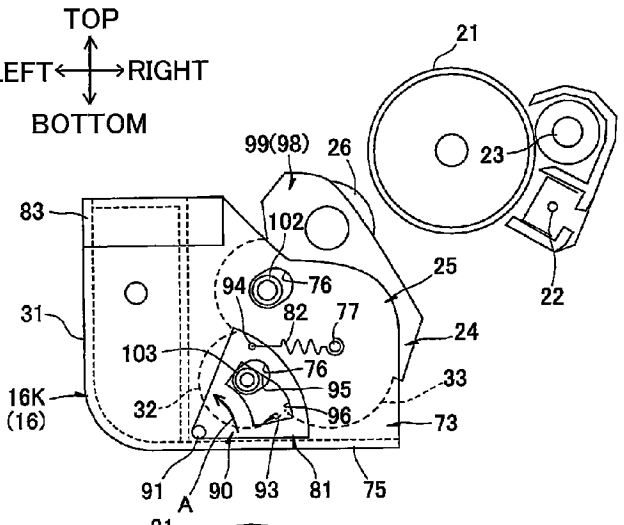
FIG. 6A is a front side view of the developing unit shown in FIG. 1, wherein a developing frame of the developing device is at a separation position.

As illustrated in FIG. 6A, the unit front wall 73 has a substantially rectangular flat plate-like shape in a front view.

The unit front wall 73 includes two guide holes 76 and a spring anchoring portion 77.

The two guide holes 76 are formed to be spaced away from each other in the up-down direction. As will be described later, the guide holes 76 are positioned to correspond to a large-diameter boss 102 and a small-diameter boss 103 of the developing device 24, respectively. Each guide hole 76 has a substantially ellipsoidal shape in a front view and is elongated in a direction X (see FIG. 6B) in which the photosensitive drum 21 and developing roller 26 oppose each other (to be referred to as "opposing direction X" hereinafter). Each guide hole 76 has a major axis substantially 1.5 times longer than an outer diameter of the corresponding boss (large-diameter boss 102 or small-diameter boss 103), while having a minor axis substantially equal to the outer diameter of the corresponding boss (large-diameter boss 102 or small-diameter boss 103).

The spring anchoring portion 77 is provided diagonally upward and rightward of the lower guide hole 76 (see FIG. 6A). As shown in FIG. 4, the spring anchoring portion 77 is formed in a substantially columnar shape, protruding frontward from a front surface (outer surface in the front-rear direction) of the unit front wall 73.

The unit bottom wall 75 has a substantially flat plate-like shape extending in the front-rear direction. As shown in FIG. 1, the unit bottom wall 75 has an upper surface on which a shaft support portion 78 is provided. Specifically, the shaft support portion 78 is disposed at a left end portion of the upper surface of the unit bottom wall 75.

The shaft support portion 78 has a generally triangular shape in a front view, and extends in the front-rear direction. The shaft support portion 78 has an upper surface that opposes the first chamber 32 of the developing device 24 when the developing device 24 is accommodated in the corresponding unit frame 25. This upper surface of the shaft support portion 78 serves as a spring support surface 79. The spring support surface 79 has a generally arcuate-shape in a front view, curving upward toward the left.

As illustrated in FIG. 5B, the unit frame 25 includes a pair of coil springs 80, a movable member 81, a pair of tension springs 82 (see FIG. 6A), and the gripping portion 83.

The coil springs 80 are formed as an air-cored coil, and are fixed to both front and rear end portions of the spring support surface 79 such that each coil spring 80 defines an axis extending in a direction substantially parallel to the opposing direction X (see FIG. 6B).

Figure 6C:
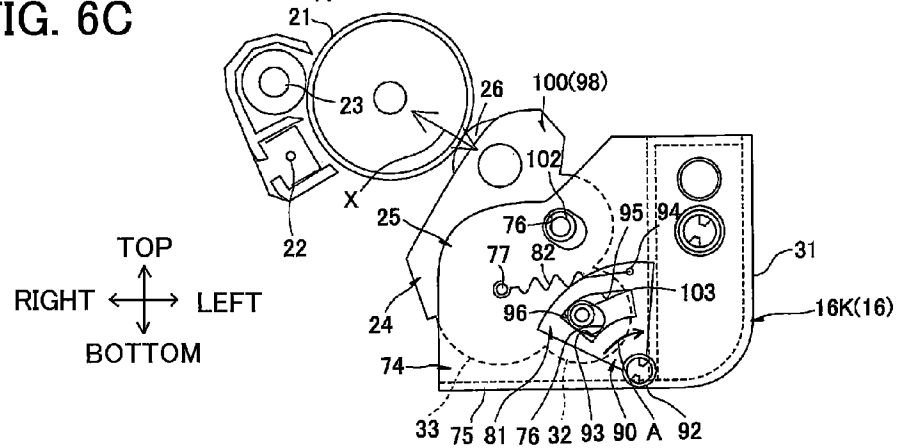
FIG. 6C is a rear side view of the developing unit of FIG. 6B.

The movable member 81 includes a pivot shaft 91, a pair of front and rear cams 90, and a unit coupling 92 (FIGS. 5B and 6C).

The pivot shaft 91 has a substantially columnar shape extending in the front-rear direction. The pivot shaft 91 is rotatably supported by the shaft support portion 78 so as to penetrate through the same in the front-rear direction at a position substantially center thereof (see FIG. 1). Further, both front and rear end portions of the pivot shaft 91 protrude outward in the front-rear direction from the unit front wall 73 and unit rear wall 74, respectively.

As illustrated in FIG. 6A, each cam 90 is a flat plate having a substantially fan-like shape whose center angle is about 60 degrees. Each cam 90 has a restriction hole 93 and an anchoring hole 94.

Hereinafter, the up-down direction, front-rear direction, and left-right direction of the cam 90 will be referred to assuming that the cam 90 is located at a second position (a state shown in FIG. 6A).

The restriction hole 93 has a generally arcuate shape extending in a circumferential direction of the cam 90 and penetrates through the cam 90 at a position substantially center thereof. The restriction hole 93 has an outer peripheral edge serving as a restriction portion 95 and an allowance portion 96.

The restriction portion 95 corresponds to a leftward portion of the outer peripheral edge of the restriction hole 93 in the circumferential direction. The restriction portion 95 extends substantially linearly toward rightward and downward from an upper-left corner of the outer peripheral edge in a front view.

The allowance portion 96 corresponds to a rightward portion of the outer peripheral edge of the restriction hole 93 in the circumferential direction. The allowance portion 96 continuously extends from a right end portion of the restriction portion 95 so as to form a curve in conformance with a circumference of the cam 90.

The anchoring hole 94 has a substantially circular shape in a front view. The anchoring hole 94 is positioned generally above the restriction portion 95 of the restriction hole 93 to penetrate through the cam 90.

As illustrated in FIG. 5B, the front and rear cams 90 are positioned outward of the unit front wall 73 and unit rear wall 74 in the front-rear direction, respectively such that the unit frame 25 is interposed between the front and rear cams 90 in the front-rear direction. The front and rear cams 90 are disposed so as to overlap (be coincident) with each other when projected in the front-rear direction (see FIGS. 6B and 6C).

The front and rear cams 90 are fixed, each at a portion adjacent to its center-angle, to the front and rear end portions of the pivot shaft 91 respectively.

Thus, as illustrated in FIGS. 6A to 6C, the front and rear cams 90 are integrally and pivotably movable about the pivot shaft 91. Specifically, the front and rear cams 90 are pivotably movable between a first position (shown in FIGS. 6B and 6C) and the second position (shown in FIG. 6A). In the first position, each cam 90 is positioned to have its left edge portion extending in parallel to the up-down direction. In the second position, each cam 90 is positioned to have its lower edge extending in parallel to the left-right direction.

As illustrated in FIGS. 5B and 6C, the unit coupling 92 is fixed to a portion connecting the rear cam 90 and the rear end portion of the pivot shaft 91. The unit coupling 92 is formed in a substantially hollow cylindrical shape and extends rearward from the connecting portion. The unit coupling portion 92 has an inner diameter substantially equal to an outer diameter of the coupling portion 70 (FIG. 2) that is to be coupled to the unit coupling 92.

As illustrated in FIG. 6A, each tension spring 82 is disposed to extend in the left-right direction. The tension spring 82 has a left end portion fixed to the anchoring hole 94, and a right end portion fixed to the spring anchoring portion 77.

With the above configuration, each cam 90 is normally biased rightward due to a tensile force of the tension spring 82 such that the cam 90 is maintained at the second position. The tensile force of the tension springs 82 is set larger than a force attributed to the biasing force of the coil springs 80 that acts in a direction causing the cams 90 to pivotally move toward the first position. However, when each cam 90 is at the second position, the biasing force of the coil springs 80 is received by the restriction portion 95 of each restriction hole 93 through the small-diameter boss 103 (to be described later). Therefore, the force attributed to the biasing force of the coil springs 80 that acts in the direction causing each cam 90 to pivotally move toward the first position becomes smaller than the actual biasing force of the coil springs 80. Thus, the tensile force of the tension springs 82 may be set smaller than the actual biasing force of the coil springs 80, provided that the tensile force of the tension springs 82 is larger than the force generated by the biasing force of the coil springs 80 that acts in the direction to move the cam 90 toward the first position.

The gripping portion 83 has a substantially U-like shape that is open rearward in a top view, as illustrated in FIG. 4.

The gripping portion 83 has both distal end portions fixed to an upper-left portion of a front end portion of the unit frame 25. More specifically, in the black developing unit 16K, the left distal end portion is fixed to an upper-left end portion of a front wall of the waste toner chamber 31, and the right distal end portion is fixed to an upper-left end portion of the unit front wall 73. In the developing units 16Y, 16M, and 16C, distal end portions of the gripping portion 83 are fixed to an upper-left end portion of the unit front wall 73 such that the gripping portion 83 spans across and over the upper guide hole 76 (refer to FIGS. 9A and 9B).

(2) Developing Device

The developing device 24 includes a developing frame 98, as shown in FIG. 4.

The developing frame 98 has a generally hollow prismatic cylindrical shape whose top and right sides are opened (see FIG. 1). The developing frame 98 extends in the front-rear direction. The developing frame 98 has a front end portion closed by a developing front wall 99, and a rear end portion closed by a developing rear wall 100.

In the present embodiment, the developing front wall 99 and developing rear wall 100 have the same configuration as each other. Thus, hereinafter, a detailed description will be given on the developing front wall 99, and descriptions for the developing rear wall 100 will be omitted.

The developing front wall 99 has a front (outer) surface on which a guided portion 101 is provided. The guided portion 101 includes the large-diameter boss 102 and the small-diameter boss 103.

As illustrated in FIG. 6A, the large-diameter boss 102 is disposed at an upper-left portion of the front surface of the developing front wall 99. The large-diameter boss 102 is formed in a substantially cylindrical shape, and protrudes frontward from the front surface of the developing front wall 99 (see FIG. 5A).

The small-diameter boss 103 is disposed below the large-diameter boss 102 with a distance defined therefrom in the up-down direction. The small-diameter boss 103 has a substantially cylindrical shape and protrudes frontward than the front wall of the developing front wall 99 (see FIG. 5A). The small-diameter boss 103 has an outer diameter smaller than that of the large-diameter boss 102, and, as illustrated in FIG. 5A, has a protruding length longer than that of the large-diameter boss 102 in the front-rear direction.

As illustrated in FIG. 4, the developing roller 26 is rotatably supported between upper end portions of the developing front wall 99 and developing rear wall 100 and is exposed upward and rearward. The toner chamber 29 is held between lower end portions of the developing front wall 99 and developing rear wall 100.

The developing device 24 is accommodated in the unit frame 25 in such a manner that the large-diameter boss 102 and small-diameter boss 103 are inserted into the corresponding guide holes 76 from inside thereof, and the small-diameter boss 103 is further inserted into the corresponding restriction hole 93 from its inside (see FIG. 6C).

Under this construction, since the large-diameter boss 102 and small-diameter boss 103 are guided by the corresponding guide holes 76, the developing frame 98 is movable in the opposing direction X (see FIG. 6B) between a proximity position (shown in FIGS. 6B and 6C) and a separation position (shown in FIG. 6A). In the proximity position, the photosensitive drum 21 and developing roller 26 are brought close to or into contact with each other. In the separation position, the photosensitive drum 21 and developing roller 26 are separated from each other.

In the present embodiment, the photosensitive drum 21 and developing roller 26 are in contact with each other when the developing frame 98 is at the proximity position (FIGS. 6B and 6C).

As illustrated in FIG. 1, the coil springs 80 are disposed between the shaft support portion 78 and the first chamber 32 (outer surface of the first chamber 32). Thus, the developing frame 98 is biased toward the photosensitive drum 21 by the biasing force of the coil springs 80 so as to cause the developing frame 98 to be displaced at the proximity position. At this time, the cams 90 are at the first position On the other hand, as illustrated in FIG. 6A, when the cams 90 are at the second position, the small-diameter boss 103 of the developing frame 98 penetrates through the restriction hole 93, and the small-diameter boss 103 has its upper-right portion abutted on the restriction portion 95 of the restriction hole 93. Thus, when the cams 90 are at the second position, the developing frame 98 is restricted from moving upward and rightward and is normally placed at the separation position against the biasing force of the coil springs 80.

5. Attachment/Detachment of the Developing Unit Relative to the Main Casing

Attachment/detachment of the developing unit 16 with respect to the main casing 2 will be described with reference to FIGS. 2 and 3.

As illustrated in FIG. 3, in order to mount the developing unit 16 into the main casing 2, first the front cover 6 is opened. A user then holds the gripping portion 83 and inserts the developing unit 16 into the unit accommodating space 67 from its front side.

The lower end portion of the unit frame 25 of the developing unit 16 is thus inserted into the corresponding guide portion 69 from its front side. That is, the guide portion 69 supports the unit frame 25 from below, and the unit frame 25 is moved in an attachment direction Y (from the front to the rear, see FIG. 3) while being guided by the guide portion 69. At this time, the developing unit 24 is moved to pass the corresponding unit groove 52 (see FIG. 1).

As the developing unit 16 (unit frame 25) is further moved rearward in the attachment direction Y and the unit rear wall 74 reaches the rear end portion of the guide portion 69 as illustrated in FIG. 2, the unit coupling 92 is coupled to the coupling portion 70 of the main body coupling 66. Specifically, the unit coupling 92 receives the coupling portion 70 therein from radially outward thereof.

Thus, attachment of the developing unit 16 to the main casing 2 (unit accommodating space 67) is completed, whereupon the developing unit 16 is positionally fixed relative to the main casing 2. This position of the developing unit 16 will be referred to as a mounted position, whenever necessary.

For detaching the developing unit 16 from the main casing 2 (unit accommodating space 67), the above-described attaching operation is performed in reverse.

As illustrated in FIG. 3, the developing unit 16 is pulled frontward from the unit accommodating space 67, while the unit frame 25 is guided by the corresponding guide portion 69. As a result, the developing unit 16 is detached from the main casing 2 (unit accommodating space 67) and is located at a detached position.

The attachment/detachment direction of the developing unit 16 relative to the main casing 2 is coincident with the axial direction of the photosensitive drum 21 (i.e., front-rear direction). That is, when the drum unit 15 is mounted in the main casing 2, the developing unit 16 can be attached/detached relative to the main casing 2 in the front-rear direction.

6. Contact/Separation of the Developing Roller Relative to the Photosensitive Drum Contact/separation of the developing roller 26 with/from the photosensitive drum 21 will be described with reference to FIGS. 6A through 6C.

As illustrated in FIG. 6A, in the developing unit 16, the developing frame 98 is normally at the separation position. That is, the developing roller 26 and photosensitive drum 21 are separated from each other.

Hence, in order to carry out image forming operations, the developing frame 98 needs to be displaced to the proximity position (FIG. 6B) so as to bring the developing roller 26 into contact with the photosensitive drum 21. To achieve this, a drive force from a motor (not illustrated) provided in the main casing 2 is inputted to the unit coupling 92 of the movable member 81 through the coupling portion 70 of the main body coupling 66.

As a result, as illustrated in FIGS. 6A and 6B, the cams 90 of the movable member 81 are pivotally moved, against the biasing force (tensile force) of the tension springs 82, about the pivot shaft 91 in a pivoting direction A (counterclockwise direction in a front view; shown by a solid arrow in FIGS. 6A to 6C). The cams 90 are thus moved from the second position (shown in FIG. 6A) to the first position (shown in FIG. 6B).

In accordance with pivotal movement of the cams 90, the restriction portion 95 is moved in the pivoting direction A, while being slid against the small-diameter boss 103, since the developing frame 98 is biased by the coil springs 80 (see FIG. 1) toward the photosensitive drum 21.

When the cams 90 are positioned at the first position as shown in FIG. 6B, contact (abutment) between the restriction portion 95 and small-diameter boss 103 is released, and the allowance portion 96 reaches the upper-right side of the small-diameter boss 103. At this instance, the allowance portion 96 and small-diameter boss 103 oppose each other in the opposing direction X with a slight gap kept therebetween.

Hence, the developing frame 98 is allowed to move upward and rightward, due to the biasing force of the coil spring 80 (see FIG. 1), until the small-diameter boss 103 abuts on the allowance portion 96. The developing frame 98 is thus moved upward and rightward to reach the proximity position. The developing roller 26 and photosensitive drum 21 are thus brought into contact with each other.

That is, at the first position, the front and rear cams 90 of the movable member 81 cause the developing frame 98 to be placed at the proximity position, while, at the second position, the front and rear cams 90 cause the developing frame 98 to be placed at the separation position.

In other words, the unit frame 25 holds the developing frame 98 such that the developing frame 98 is movable between the proximity position and the separation position when the developing unit 16 is mounted in the main casing 2.

Moving the developing frame 98 from the separation position to proximity position is thus completed.

For moving the developing frame 98 from the proximity position to separation position, the above-described operation for moving the developing frame 98 from the separation position to proximity position is performed in reverse.

Further, when the developing unit 16 is moved (pulled) frontward from the main casing 2, connection (coupling) between the unit coupling 92 and the coupling portion 70 (see FIG. 2) of the main body coupling 66 is released. The cams 90 are therefore moved from the first position (FIG. 6B) to the second position (FIG. 6A) due to the tensile force of the tension springs 82, thereby allowing the developing frame 98 to be displaced from the proximity position to the separation position.

7. Technical Advantages (1) As illustrated in FIG. 3, in the color printer 1, the developing unit 16 can be attached to/detached from the main casing 2 in a state where the drum unit 15 (photosensitive drum 21) is accommodated in the main casing 2. The developing unit 16 having a shorter service life than that of the photosensitive drum 21 can therefore be replaced independently of the photosensitive drum 21.

Further, as illustrated in FIGS. 6A and 6B, the unit frame 25 of the developing unit 16 holds the developing frame 98 such that the developing frame 98 is movable between the proximity position and separation position. Thus, the developing frame 98 can be placed at the separation position during attachment/detachment of the developing unit 16, thereby preventing sliding contact between the developing roller 26 and photosensitive drum 21.

Further, compared to a configuration in which attachment/detachment of the developing unit 16 relative to the main casing 2 is guided by a movable member, the above-described construction of the present embodiment can achieve more stable attachment/detachment of the developing unit 16 relative to the main casing 2.

Hence, even if a distance between the developing roller 26 and photosensitive drum 21 is set smaller when the developing frame 98 is at the separation position, interference between the developing roller 26 and photosensitive drum 21 can be prevented at the time of attachment/detachment of the developing unit 16 relative to the main casing 2.

Therefore, running costs can be reduced, while the photosensitive drum 21 and developing roller 26 can be prevented from being damaged. Also, downsizing of the color printer 1 can be realized.

(2) Further, as illustrated in FIG. 3, the guide portion 69 for guiding the movement of the unit frame 25 during attachment/detachment of the developing unit 16 relative to the main casing 2 is fixed to the partition wall 65 of the main casing 2.

Thus, when the developing unit 16 is mounted in and dismounted from the main casing 2, the unit frame 25 is reliably guided by the corresponding guide portion 69.

As a result, the developing unit 16 is prevented from moving (rattling) in a direction perpendicular to a guiding direction of the guide portion 69 (front-rear direction) during mounting/detachment of the developing unit 16. Interference between the developing roller 26 and photosensitive drum 21 can therefore be prevented reliably.

The photosensitive drum 21 and developing roller 26 can therefore be reliably prevented from being damaged, and a further reduction in size of the color printer 1 can be achieved.

(3) Further, as illustrated in FIG. 1, the coil springs 80 for biasing the developing frame 98 toward the proximity position are provided on the spring support surface 79 of the unit frame 25.

Therefore, due to the biasing force of the coil springs 80 biasing the developing frame 98 toward the proximity position, the developing roller 26 is pressed against the photosensitive drum 21 when the developing frame 98 is at the proximity position. Thus, the developing roller 26 is positioned with accuracy relative to the photosensitive drum 21 when the developing frame 98 is at the proximity position.

(4) Further, as illustrated in FIGS. 6A and 6B, the unit frame 25 has the pair of front and rear cams 90 that is movable between the first position (FIG. 6B) to bring the developing frame 98 at the proximity position and the second position (FIG. 6A) to bring the developing frame 98 at the separation position.

Therefore, through a simple configuration, the developing frame 98 can be reliably moved between the proximity position and separation position.

(5) Further, as illustrated in FIG. 6A, the pair of front and rear cams 90 allows the developing frame 98 to be positioned at the separation position against the biasing force of the coil springs 80.

Therefore, despite the provision of the coil springs 80 (see FIG. 1) in the unit frame 25, the developing frame 98 can be reliably located at the separation position.

That is, relative positioning accuracy between the developing roller 26 and photosensitive drum 21 when the developing frame 98 is at the proximity position can be improved, whereas, the developing frame 98 can be reliably displaced to be at the separation position during mounting/dismounting of the developing unit 16 relative to the main casing 2.

(6) Further, as illustrated in FIG. 3, the movable member 81 includes the unit coupling 92 to which the drive force for moving the cam 90 is inputted. The unit coupling 92 is provided at a portion of the movable member 81, the portion connecting between the rear cam 90 and the rear end portion of the pivot shaft 91 (i.e., downstream end portion in the attachment direction Y in which the developing unit 16 is attached to the main casing 2).

Thus, the drive force can be reliably inputted to the movable member 81, while ensuring efficient arrangement of the unit coupling 92. Due to the inputted drive force, the cams 90 are allowed to move between the first position and second position, as illustrated in FIGS. 6A to 6C.

(7) Further, the unit frame 25 has the tension springs 82 for biasing the cams 90 toward the second position.

Thus, the cams 90 are normally at the second position, and the developing frame 98 can be normally positioned at the separation position.

As a result, interference between the developing roller 26 and photosensitive drum 21 can be reliably prevented while the developing unit 16 is being attached/detached relative to the main casing 2.

In particular, even if the color printer 1 is powered off due to unforeseen circumstances such as blackout, the developing frame 98 can be displaced to the separation position by releasing the coupling (connection) between the unit coupling 92 and coupling portion 70 (see FIG. 2) of the main body coupling 66.

As a result, even in case of occurrence of unforeseen circumstances such as blackout, the developing roller 26 and photosensitive drum 21 can be prevented from sliding against each other during detachment of the developing unit 16 from the main casing 2.

(8) Further, as illustrated in FIG. 3, the unit frame 25 has, at its front end portion (upstream end portion in the attachment direction Y), the gripping portion 83 for attaching/detaching the developing unit 16 relative to the main casing 2.

Thus, the user can hold the gripping portion 83 when mounting and detaching the developing unit 16 relative to the main casing 2. Smooth attachment/detachment of the developing unit 16 relative to the main casing 2 can be ensured.

In particular, suppose that the gripping portion 83 is provided at the developing device 24 (developing frame 98). In this case, the attachment/detachment operation of the developing unit 16 could be unstable, since the developing frame 98 is movable in the opposing direction X (see FIG. 6B). As a result, conceivably, the developing roller 26 is caused to slide against the photosensitive drum 21. However, in contrast, when the gripping portion 83 is provided at the unit frame 25 as in the present embodiment, the above problem can be prevented.

8. Second Embodiment

Next, a developing unit 216 according to a second embodiment of the present invention will be described with reference to FIGS. 7A and 7B.

Figure 7B:
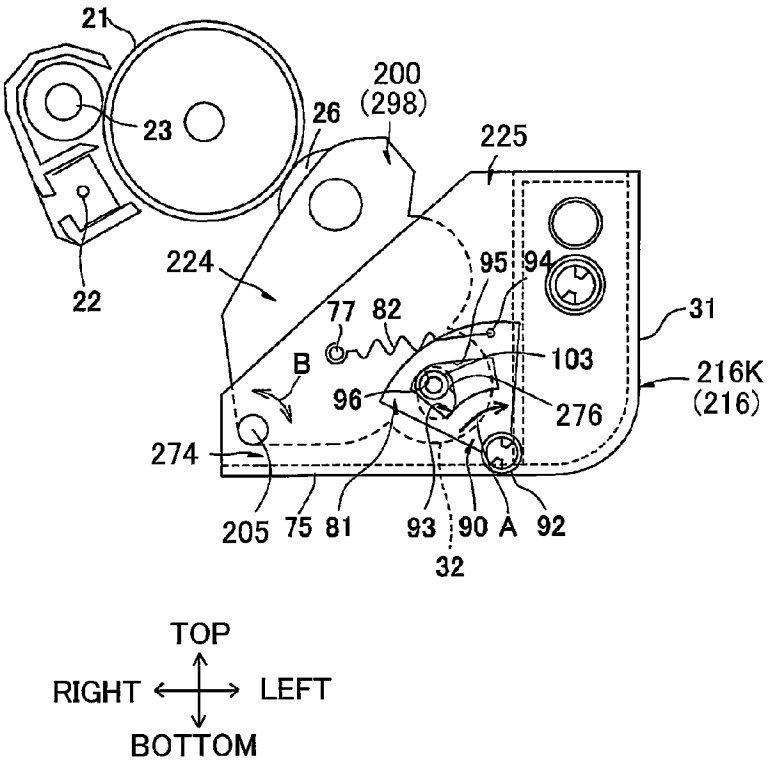
FIG. 7B is a rear side view of the developing unit mountable in the color printer according to the second embodiment of the present invention, wherein a developing frame is at a proximity position.
Figure 7A:
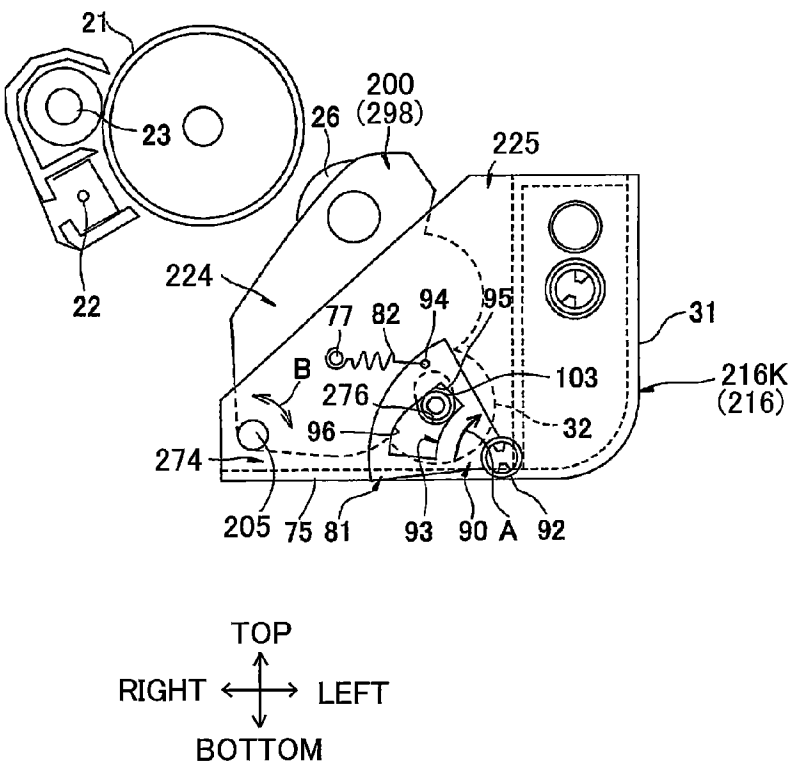
FIG. 7A is a rear side view of a developing unit mountable in a color printer according to a second embodiment of the present invention, wherein a developing frame is at a separation position.

In FIGS. 7A and 7B, like parts and components will be designated with the same reference numerals as those of the first embodiment to avoid duplicating description. Further, in order to duplicate description, a construction different from that of the first embodiment will only be described in the following description.

In the first embodiment, the developing frame 98 is movable in the opposing direction X between the proximity position (see FIG. 6B) and separation position (see FIG. 6A). In contrast, in the second embodiment, as illustrated in FIGS.

7A and 7B, a developing frame 298 is pivotably movable about a pivot shaft 205 between the proximity position (shown in FIG. 7B) and separation position (shown in FIG. 7A) (described later) with respect to a pivoting direction B indicated by an arrow in FIGS. 7A and 7B.

Specifically, the developing frame 298 is provided with the pivot shaft 205.

The pivot shaft 205 is formed in a substantially columnar shape extending in the front-rear direction. The pivot shaft 205 has both front and rear end portions non-rotatably supported to the developing frame 298 each at a lower-right end portion thereof. The front and rear end portions protrude outward in the front-rear direction from a developing front wall 299 and a developing rear wall 200, respectively.

The front and rear end portions of the pivot shaft 205 are rotatably supported by a unit front wall 273 and a unit rear wall 274, respectively (the unit front wall 273 is not shown in FIGS. 7A and 7B). In other words, a developing device 224 is supported to a unit frame 225 so as to be pivotally movable in the pivoting direction B.

In the second embodiment, a guide hole 276 corresponding to the small-diameter boss 103 is formed in a substantially ellipsoidal shape generally extending in the up-down direction. However, unlike the first embodiment, the upper guide hole 76 corresponding to the large-diameter boss 102 is not necessary to be formed in each of the unit front wall 273 and unit rear wall 274.

The developing device 224 is moved to the proximity position (FIG. 7B) from the separation position (FIG. 7A) due to the biasing force of the coil springs 80 provided on the unit frame 225, as in the first embodiment. The developing device 224 is moved to the separation position (FIG. 7A) from the proximity position (FIG. 7B) due to the tensile force of the tension springs 82, as in the first embodiment.

In this second embodiment, the same technical advantages as those in the first embodiment can be achieved.

Further, in the second embodiment, the cams 90 may be provided at only one of the front and rear end portions of the pivot shaft 91. Also in this case, the developing frame 298 is reliably pivotally movable between the proximity position (see FIG. 7B) and separation position (see FIG. 7A). This construction can serve to a further reduction in number of parts.

9. Third Embodiment

Next, a developing unit 316 according to a third embodiment of the present invention will be described with reference to FIGS. 8A to 8C.

Figures 8A, 8B, 8C:
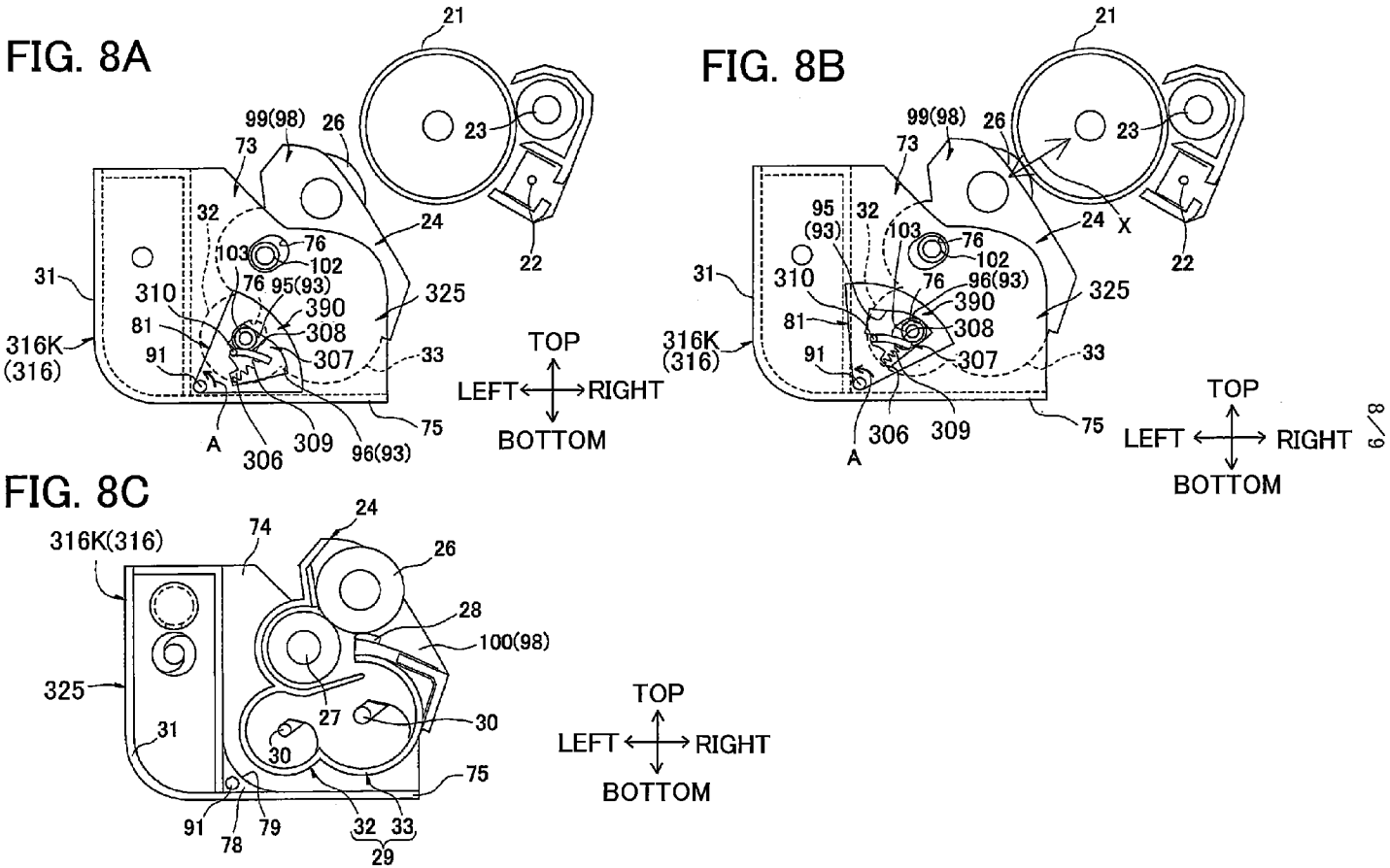
FIG. 8A is a front side view of a developing unit mountable in a color printer according to a third embodiment of the present invention, wherein a developing frame is at a separation position.
FIG. 8B is a front side view of the developing unit mountable in the color printer according to the third embodiment of the present invention, wherein the developing frame is at a proximity position.
FIG. 8C is a cross-sectional view of the developing unit of FIG. 8A.

In FIGS. 8A through 8C, like parts and components will be designated with the same reference numerals as those of the first embodiment to avoid duplicating description. Further, in order to duplicate description, a construction different from that of the first embodiment will only be described in the following description.

In the first embodiment, the coil springs 80 are disposed between the shaft support portion 78 and the first chamber 32, as shown in FIG. 1. In the third embodiment, as illustrated in FIG. 8C, the coil springs 80 are not provided between the shaft support portion 78 and the first chamber 32 of the developing device 24.

Instead of the coil springs 80 of the first embodiment, in the third embodiment, as illustrated in FIG. 8A, a pressing member accommodating groove 306 is formed in each of front and rear cams 390 in a unit frame 325. A pressing member 307 is accommodated in each pressing member accommodating groove 306.

The pressing member accommodating groove 306 is formed in continuous with an inner peripheral edge of the restriction hole 93. Specifically, the pressing member accommodating groove 306 is formed as a recessed portion that is depressed radially inward toward the pivot shaft 91 from a rightward portion (upstream end portion in the pivoting direction A) of the inner peripheral edge of the restriction hole 93.

Each pressing member 307 includes a pivoting portion 308 and a coil spring 309.

The pivoting portion 308 is formed in a substantially arcuate shape in a front view. The pivoting portion 308 has a left end portion (downstream end portion in the pivoting direction A) at which a pivot shaft 310 is provided. The pivot shaft 310 is rotatably supported to a peripheral portion of the inner peripheral edge of the corresponding restriction hole 93, thereby allowing the pivoting portion 308 to pivotally move relative to the corresponding cam 390.

Each coil spring 309 is disposed to extend in the radial direction of the corresponding cam 390. The coil spring 309 has one end fixed to a deepest portion of the pressing member accommodating groove 306, and another end fixed to a radially inner surface of a right end portion (upstream end portion in the pivoting direction A) of the pivoting portion 308. That is, the coil spring 309 is disposed between the deepest portion of the pressing member accommodating groove 306 and the right end portion (upstream end portion in the pivoting direction A) of the pivoting portion 308.

With this structure, the right end portion of the pivoting portion 308 is normally biased outward in the radial direction of the cam 390 and, accordingly, the pivoting portion 308 functions to press the corresponding small-diameter boss 103 from below. Therefore, the cams 390 are normally placed at the second position.

When the cam 390 is at the second position, the upper-right portion of the small-diameter boss 103 abuts on the restriction portion 95, and the upper-left portion of the small-diameter boss 103 abuts on a left end edge (downstream end portion in the pivoting direction A) of the restriction hole 93.

When the cams 390 is located at the second position, the developing frame 98 is restricted from moving upward and rightward to be placed at the separation position against the biasing force of the coil spring 309.

When the cam 390 is moved from the second position to the first position (see FIG. 8B), the allowance portion 96 reaches the upper-right portion of the small-diameter boss 103 to be in opposition to and in separation from the small-diameter boss 103 in the opposing direction X.

Since the small-diameter boss 103 is biased upward and rightward by the coil spring 309 via the pivoting portion 308, the developing frame 98 is moved upward and rightward.

As a result, the developing frame 98 is moved to the proximity position (FIG. 8B) at which the developing roller 26 and photosensitive drum 21 are in contact with each other.

In this third embodiment as well, the unit frame 325 holds the developing frame 98 such that the developing frame 98 is movable between the proximity position and separation position, as illustrated in FIGS. 8A and 8B. The same technical advantages as those in the first embodiment can also be achieved.

10. Fourth Embodiment

Next, a developing unit 416 according to a fourth embodiment of the present invention will be described with reference to FIGS. 9A and 9B.

Figure 9A:
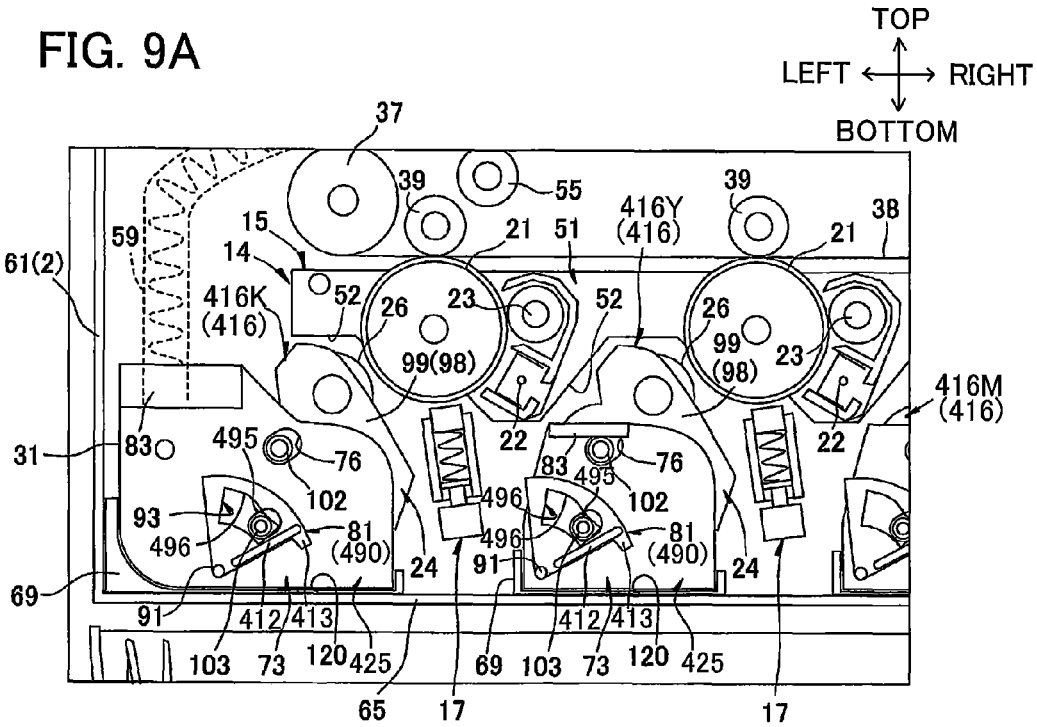
FIG. 9A is a front side view of a developing unit mountable in a color printer according to a fourth embodiment of the present invention, wherein a developing frame is at a separation position.
Figure 9B:
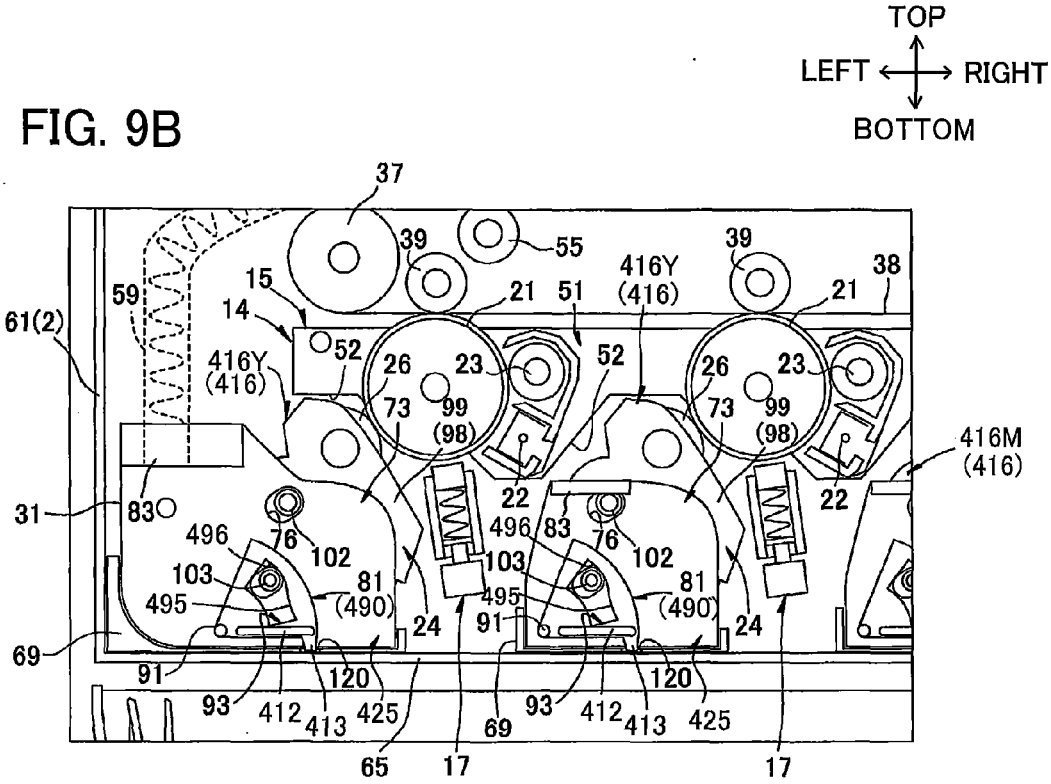
FIG. 9B is a front side view of the developing unit mountable in the color printer according to the fourth embodiment of the present invention, wherein the developing frame is at a proximity position.

In FIGS. 9A and 9B, like parts and components will be designated with the same reference numerals as those of the first embodiment to avoid duplicating description. Further, in order to duplicate description, a construction different from that of the first embodiment will only be described in the following description.

In the first embodiment, the drive force from a motor (not illustrated) is inputted to the unit coupling 92 of the movable member 81 through the coupling portion 70 of the main body coupling 66 (see FIG. 2), as illustrated in FIGS. 6A and 6B. The cams 90 are therefore caused to pivotally move between the first position (FIG. 6B) and second position (FIG. 6A).

On the other hand, in the fourth embodiment, as illustrated in FIGS. 9A and 9B, a user manually moves cams 490 between the first position (see FIG. 9B) and the second position (see FIG. 9A).

Specifically, each cam 490 is formed with a restriction hole 493. The restriction hole 493 has an outer peripheral edge whose rightward portion and leftward portion serve as a restriction portion 495 and an allowance portion 496, respectively.

Further, the front cam 490 includes a handle 412 and an abutment portion 413.

The handle 412 is formed in a substantially rectangular shape in a front view, and extends in the radial direction of the cam 490. The handle 412 protrudes frontward from a lower end portion of a front surface of the front cam 490.

The abutment portion 413 has a substantially a rectangular shape in a front view. The abutment portion 413 protrudes from a right end portion of the lower end portion of the front cam 490 and extends therefrom generally downward following the circumferential direction of the front cam 490.

Further, as shown in FIG. 9B, an engagement hole 120 is formed in a lower wall of the guide portion 69 at a position corresponding to the abutment portion 413. The engagement hole 120 penetrates the lower wall of the guide portion 69 in the up-down direction so as to allow a lower end portion of the abutment portion 413 to be inserted therethrough.

The user holds the handle 412 to manually move the cams 490 between the first position and second position. As a result, the developing frame 98 can be moved between the proximity position and separation position in a state where the developing frame 98 is accommodated in the unit frame 25.

Further, as illustrated in FIG. 9B, when the cams 490 are located at the first position, the abutment portion 413 is inserted into and engaged with the engagement hole 120 of the guide portion 69. The lower end portion of the abutment portion 413 thus abuts against the upper surface of the partition wall 65. This abutment restricts further pivotal movement of the cams 490. This engagement between the abutment portion 413 and engagement hole 120 also restricts the developing unit 416 from being moved frontward (toward the near side in FIG. 9B) from the main casing 2 in the state where the cams 490 are at the first position.

As illustrated in FIG. 9A, since the engagement between the abutment portion 413 and engagement hole 120 is released when the cams 490 are at the second position, the developing unit 16 is permitted to be pulled frontward (to the near side in FIG. 9A) from the main casing 2.

The same technical advantages as those in the first embodiment can also be achieved in the fourth embodiment.

Further, in the fourth embodiment, there is no need to provide the main body coupling 66 (see FIG. 3) and unit coupling 92 (see FIG. 3), leading to further reduction in the number of parts.

11. Variations and Modifications

In the above-described first to fourth embodiments, the developing roller 26 and the corresponding photosensitive drum 21 are in contact with each other when the developing frame 98 is at the proximity position, as shown in FIG. 6B, for example.

However, alternatively, a slight gap may be provided between the developing roller 26 and the corresponding photosensitive drum 21 when the developing frame 98 is at the proximity position, provided that toner can fly (to be transferred) from the developing roller 26 to the photosensitive drum 21.

Under such construction, the toner can be supplied from the developing roller 26 to the corresponding photosensitive drum 21 despite the gap when the developing frame 98 is at the proximity position. When the developing frame 98 is at the separation position, the developing roller 26 and corresponding photosensitive drum 21 can be reliably separated from each other.

Thus, toner can be reliably supplied to the photosensitive drum 21 during image formation, while interference between the developing roller 26 and photosensitive drum 21 during attachment/detachment of the developing unit 16 can be reliably prevented.

Further, the above-described first to fourth embodiments and variations thereof can be combined appropriately.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a developing unit; and a main body including:

a main casing;

a photosensitive drum supported by the main casing, the photosensitive drum being configured to rotate about a rotational axis; and a guide member configured to guide movement of the developing unit relative to the main casing in a first direction parallel to the rotational axis during attachment or detachment of the developing unit to the main casing, wherein the developing unit comprises:

a developer carrying member configured to carry developer to the photosensitive drum;

a developing frame supporting the developer carrying member; and a supporting assembly configured to support the developing frame, the supporting assembly being configured to move the developing frame between a proximity position and a separation position in a state where the developing unit is attached to the main casing, wherein the developer carrying member contacts the photosensitive drum when the developing frame is at the proximity position, and wherein the developer carrying member is separated from the photosensitive drum when the developing frame is at the separation position.

2. The image forming apparatus as claimed in claim 1, wherein the supporting assembly further comprises a first spring member configured to apply a force to move the developing frame in a direction from the separation position toward the proximity position.

3. The image forming apparatus as claimed in claim 1, wherein the supporting assembly further comprises a movable member movable between a first position and a second position, the movable member being configured to move the developing frame from the separation position to the proximity position while the movable member moves from the second position to the first position.

4. The image forming apparatus as claimed in claim 3, wherein the movable member is provided with a driven portion configured to receive a driving force to move the movable member, the movable member having an end portion positioned downstream in the first direction and the driven portion being provided at the downstream end portion of the movable member.

5. The image forming apparatus as claimed in claim 1, wherein the supporting assembly further comprises:

a first spring member configured to apply a force to move the developing frame in a direction from the separation position toward the proximity position; and a movable member movable between a first position and a second position, the movable member being configured to move the developing frame from the separation position to the proximity position while the movable member from the second position to the first position.

6. The image forming apparatus as claimed in claim 5, wherein the supporting assembly further comprises a second spring member configured to apply a force to move the movable member in a direction from the first position toward the second position.

7. The image forming apparatus as claimed in claim 6, wherein the movable member is a cam.

8. The image forming apparatus as claimed in claim 1, wherein the supporting assembly has an end portion positioned upstream in the first direction, the upstream end portion being provided with a gripping portion for user's gripping during attachment or detachment of the developing unit relative to the main casing.

9. An image forming apparatus comprising:

a developing unit; and a main body including:

a main casing;

a photosensitive drum supported by the main casing, the photosensitive drum being configured to rotate about a rotational axis; and a guide member configured to guide movement of the developing unit relative to the main casing in a first direction parallel to the rotational axis during attachment or detachment of the developing unit relative to the main casing, wherein the developing unit comprises:

a developer carrying member configured to supply developer to the photosensitive drum;

a developing frame supporting the developer carrying member; and a supporting assembly supporting the developing frame, the supporting assembly being configured to move the developing frame between a proximity position and a separation position in a state where the developing unit is attached to the main casing, wherein a distance between the developer carrying member and the photosensitive drum at the proximity position is smaller than a distance between the developer carrying member and the photosensitive drum at the separation position.

10. The image forming apparatus as claimed in claim 9, wherein the developing unit further comprises:

a cam movable between a first position and a second position, the cam being configured to move the developing frame from the separation position to the proximity position while the cam moves from the second position to the first position; and a spring configured to apply a force to move the cam in a direction from the first position toward the second position.

11. The image forming apparatus as claimed in claim 9, further comprising a sheet supply tray disposed in the main casing, the sheet supply tray being configured to accommodate a sheet therein to be supplied for image formation, wherein the developing unit is disposed between the sheet supply tray and the photosensitive drum when the developing unit is attached to the main casing.

* * * * *